US010053932B2

(12) United States Patent
Sipos

(10) Patent No.: US 10,053,932 B2
(45) Date of Patent: Aug. 21, 2018

(54) WIDE OPEN SPIDER TOOL

(71) Applicant: David L Sipos, Youngsville, LA (US)

(72) Inventor: David L Sipos, Youngsville, LA (US)

(73) Assignee: Vermilion River Tool and Equipment Company, Inc., Lafayette, LA (US)

( * ) Notice: Subject to any disclaimer, the term of this patent is extended or adjusted under 35 U.S.C. 154(b) by 288 days.

(21) Appl. No.: 14/684,185

(22) Filed: Apr. 10, 2015

(65) Prior Publication Data

US 2015/0292276 A1 Oct. 15, 2015

Related U.S. Application Data

(60) Provisional application No. 61/978,067, filed on Apr. 10, 2014.

(51) Int. Cl.
*E21B 19/10* (2006.01)
*E21B 19/08* (2006.01)

(52) U.S. Cl.
CPC ..... *E21B 19/10* (2013.01); *E21B 19/08* (2013.01)

(58) Field of Classification Search
CPC ..... E21B 19/10; E21B 19/08; E21B 19/143; E21B 19/155; E21B 19/164
See application file for complete search history.

(56) References Cited

U.S. PATENT DOCUMENTS 1,966,454 A 7/1934 Moody
6,386,283 B1 * 5/2002 Mosing ..... E21B 19/06 166/75.14
6,915,868 B1 * 7/2005 Mosing ..... E21B 19/06 166/380
6,948,575 B1 * 9/2005 Mosing ..... E21B 19/00 166/380
7,267,168 B1 * 9/2007 Sipos ..... E21B 19/10 166/75.14
7,775,270 B1 * 8/2010 Sipos ..... E21B 19/07 166/77.52
7,891,469 B1 * 2/2011 Sipos ..... E21B 19/10 175/195
8,573,312 B2 11/2013 Sonnier
2002/0033277 A1 * 3/2002 Mosing ..... E21B 19/06 175/52
2002/0166669 A1 * 11/2002 Sipos ..... E21B 19/07 166/379
2010/0200221 A1 * 8/2010 Sipos ..... E21B 19/07 166/250.01

* cited by examiner

*Primary Examiner* — D. Andrews
*Assistant Examiner* — Yanick A Akaragwe

(57) ABSTRACT

A pipe gripping apparatus is disclosed having a plurality slips slidably mounted on corresponding slip support surfaces disposed radially the vertical axis of a central opening. The slip support surfaces include an upper region having a radially outwardly curved surface and a lower region having a flat inwardly tapered surface with respect to the vertical axis of the central opening. Powered actuators and a timing ring pivotally linked to the slips move the slips towards and away from each other along their corresponding slip support surfaces to engage and release a pipe. Move of the slips fully upward and outward along outwardly curved slip support surfaces will substantially remove the slips from the central opening to prevent obstruction of the central opening by the slips.

18 Claims, 3 Drawing Sheets

WIDE OPEN SPIDER TOOL

PRIORITY

This application claims priority to U.S. provisional application Ser. No. 61/978,067 filed Apr. 10, 2014 entitled "Wide Open Spider Tool", the entire content of which is hereby incorporated by reference.

FIELD OF THE INVENTION

This invention relates to pipe gripping devices typically known as spiders and elevators used in the exploration and production of oil and gas. More particularly, the invention relates to a powered flush mounted spider or an elevator comprised of a plurality of pipe gripping assemblies retractable along a curved slip carrier to facilitate passage of pipe string segments having larger diameter pipe collars.

BACKGROUND

During the drilling of an oil and gas well, long strings of pipe are strung together to form a drill string or to form a casing string to line the well bore. These pipe strings are usually supported by rotary spiders that fit into or over the opening of a rotary table on the drilling rig. Spiders typically employ slips that are peripherally distributed around the perimeter of the central opening of an inwardly tapered slip bowl. The slips are typically fitted with detachable dies having a plurality of teeth which form a pipe gripping surface to increase the grip of the slips on the pipe string.

Spider slips are typically attached to a slip timing ring by a linkage so that upward and downward movement of the slip timing ring will simultaneously move the slips upward and downward in the slip bowl for engaging and releasing the pipe string. Hydraulically or pneumatically powered cylinders having extendable and retractable pistons and rods are typically used to raise and lower the slip timing ring. Retraction of the cylinder piston rods moves the timing ring and thus the slips downward so that the inwardly tapered slip bowl surface will urge the downwardly moving slips radially inward to bear upon and grip the pipe. Extension of the cylinder piston rods moves the timing ring and thus the slips upward in the tapered slip bowl so that the upwardly moving slips move radially outward away from the pipe string in order to release the pipe.

Ordinarily a spider should have the lowest possible elevation profile with respect to the top of the rotary table. A spider with a low elevation profile allows a worker to work at a more convenient height above the top of the rotary table and a low spider elevation profile provides less interference from the spider during the manipulation of tongs and other pipe handling equipment. However, as wellbore depth increases pipe strings become longer, heavier, and are made of pipe of larger diameters, necessitating the need of a high capacity spider. In a typical high capacity spider, the central opening for the pipe of a high capacity spider is restricted by the size of the slips required to retain the pipe string load and the diameter of the pipe collars ultimately limiting the size of the pipe and the length of the pipe string. Consequently, there is a need for a flush mounted rotary table spider that provides workers with room to work while maximizing the usable space in central opening of the spider to allow pipe collars to pass without interference.

SUMMARY OF THE INVENTION

Applicant proposes a powered spider having slip support surfaces with an upper region gradually curved outwardly from the vertical axis of the central opening of the spider and wellbore and a lower region flat and inwardly tapered. The spider disclosed is comprised of a plurality of vertically oriented slip carrier plates that have an inwardly tapered slip support surface at their lower end and a radially outwardly curved slip support surface at their upper end. The Slip carrier plates are arrayed around and attached to upper and lower support rings.

The slip carrier plates and support rings create a central opening through which a pipe or pipe string may be inserted. The slip support surface on each slip carrier plate corresponds to slip slide surface on a pipe gripping slip. The pipe gripping slips are slidably attached to the slip carrier plates by the slip support surfaces and slip slide surfaces so that each pipe gripping slip will be slidably supported on its corresponding slip carrier plates. The slip slides on the pipe gripping slips and the slip slide support surfaces on the slip carrier plates allow the pipe gripping slips to move inward and outward from the central opening and an inserted pipe to grip and release the inserted pipe as the slips are moved downward and upward along the slip carrier plates. The pipe gripping slips have a gripping surface for engagement with the pipe surface. The pipe gripping surface may be enhanced with a toothed or irregularly surfaced gripping die or dies to enhance the grip of the pipe gripping slips. The pipe gripping surfaces on the pipe gripping slips or on the pipe gripping dies may be V-shaped.

While slip support surfaces are shown and described as being in combination with slip carrier plates, the slip carrier plates could be replaced with an outwardly curved and inwardly tapered circular slip bowl or ring having slip slide support surfaces corresponding to the slip slides on the pipe gripping slips.

Each slip carrier plate and pipe gripping slip is pivotally attached to a timing ring with a slip hanger and a pivot link. Powered linear actuators mounted between the timing ring and the lower support ring and are used to move the timing ring upward and downward by retraction and extension of the linear actuators. Upward and downward movement of the timing ring will then slide the pipe gripping slips in unison upward and downward along the inwardly tapered slip carrier plates and radially inward and outward to grip and release an inserted pipe. Continued upward extension of the linear actuators will move the pipe gripping slips radially outward along the upper outwardly curved surface of the slip carrier plates away from the central opening created by the slip carrier plates and support rings.

Because the opposing slips of the slip assemblies are positioned to move in unison radially outward along the outward curved slip support surface on the slip carrier plates, this radial outward movement allows the pipe gripping slips to be move outward from the central opening created by the slip carrier plates and support rings to reduce the interference of the central opening with the pipe gripping slips and effectively increase the width of available pipe space within the central opening. The allows the spider to accommodate a wider range of pipe sizes, larger and wider pipe collars, or allows space for subs, tools, umbilicals, or other accessories to clear the central opening without the necessity of opening and removing the slider from the rotary opening. This enhanced opening is particularly beneficial when the diameter of associated tools and subs present a problem during snubbing or during entry of the pipe string in the wellbore.

Still further, because the increased outward movement of the pipe gripping slips enhances the unobstructed width of the central opening, workers will have a wider access area around a pipe string in the wellbore opening when perform normal and diagnostic operations at and around the pipe string. This wider access area will reduce the risk of injury associated with the cramped space between the pipe gripping slips and the pipe string.

The powered spider described herein may be used both as a stationary pipe gripping device and as a traveling pipe gripping device in snubbing equipment. The powered spider described herein may also be adapted for use in a rotary table spider or adapted for a hoist for use as an elevator.

These and other objects, advantages, and features of this invention will be apparent to those skilled in the art from a consideration of this specification, including the claims and drawings herein.

Figure 1:
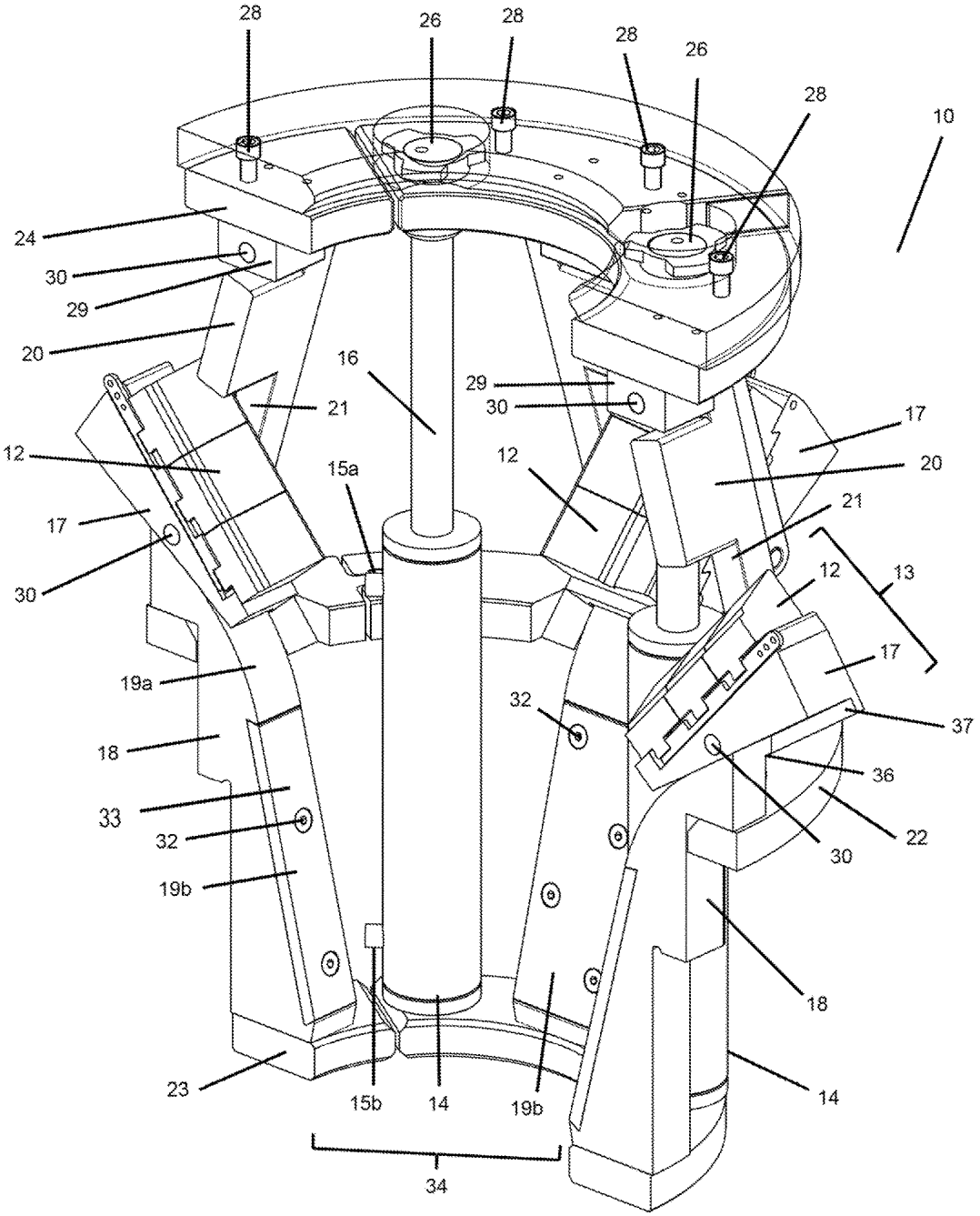
FIG. 1 is a perspective cross-sectional view of the pipe gripping apparatus of Applicant's invention configured as a spider with the pipe gripping slips in an open position.

These drawings omit features that are well established in the art and do not bear upon points of novelty in the interest of descriptive clarity. Such omitted features may include threaded junctures, weld lines, sealing elements, pins and brazed junctures.

DESCRIPTION OF THE INVENTION

The drawings show the pipe gripping apparatus of Applicant's invention configured as a pipe gripping spider (10). The spider (10) is comprised of an upper support ring (22), a lower support ring (23), and an internal array of outwardly curved and inwardly tapered slip support plates (18) that extend between an upper support ring (22) and lower support ring (23). The slip support plates (18) are attached to the ring sections (22) and (23) by means of attachment bolts (not pictured) or other suitable means. Each of the slip support plates (18) slidably supports a slip assembly (13) having a pipe gripping slips (17) and die or gripping member (12). The slips (17) are slidably moved along the curved slip support plate (18) by means of powered actuators (14).

As shown in the drawings, the split upper support ring (22) is comprised of a first upper support ring section (22*a*) and a second upper support ring section (22*b*). The split support ring sections (22*a*, 22*b*) forming the upper support ring (22) will be fastened together when the spider (10) is in use. Similarly, the split lower support ring (23) is comprised of a first lower support ring section (23*a*) and a second lower support ring section (23*b*) that will be fastened together when the spider (10) is in use.

Any suitable means may be used to hold the split support ring sections (22*a*, 22*b*) together to form the upper support ring (22) and the split lower support ring sections (23*a*, 23*b*) together to form the lower support ring (23). Such suitable means for holding the split support ring sections (22*a*, 22*b*, 23*a*, 23*b*) together would include bolts, clamps, keys, or other types of fastening or locking mechanisms. However, the split support ring sections (22*a*, 22*b*) and support ring sections (23*a*, 23*b*) may be confined together within any opening, such as the opening in a rotary table of a drilling rig, to form the support rings (22) and (23) and thus eliminating the need for fastening thee support ring sections (22*a*, 22*b*) and (23*a*, 23*b*) together.

The support rings (22) and (23) and the array of slip support plates (18) create a ringed opening (34) through which a pipe or pipe string may be inserted. Each curved slip support plate (18) has an upper radially outwardly curved slip support surface (19*a*) and a lower inwardly tapered slip support surface (19*b*) best seen in FIG. 1. The slip support plates (18) have an extending T-shaped edge (36) for engagement with a T-slot (37) provided on the slips (17) of each slip assembly (13). Tapered support surface (19*b*) is provided with a slide surface plate (33) attached to curved slip support plate (18) by support surface attachment means (32) such as a screw, bolt, pin, or the like. Slide surface plate may be polished or otherwise coated to create flush, flat surface upon which slips (17) may slide.

The outwardly curved slip support surface (19*a*) of slip support plates (18) follows a simple curve formed by the intersection of tangential lines created by flat slip support surface (19*b*) and the back surface of gripping member (12) when the slip (17) is in the angled position desired for full retraction. The length of curved slip support plate (18) may be changed as desired to suit the function to which the spider (10) is employed.

Each slip (17) of slip assembly (13) is pivotally attached to timing ring (24) by means of a slip hanger (20) and pivot links (30). The timing ring (24) may be split into sections (24*a*, 24*b*) in order to coincide with the sections (22*a*, 22*b*) of the split upper support ring (22) and sections (23*a*, 23*b*) of the split lower support ring (23).

Hydraulic cylinder actuators (14) having extendable and retractable pistons (16) are positioned linearly between the timing ring (24) and the lower support ring (23). With the timing ring (24) fixed to the actuator pistons (16) by piston bolt (26) and with the lower support ring (23) fixed to the powered actuator (14), the timing ring (24) may be moved vertically upward away from upper support ring (22) by input of fluid or air into lower hydraulic port (15*b*) of actuators (14) to extend piston (16), which will in turn move the slips (17) of the slip assemblies (13) by means of the slip hangers (20) away from each other along radially outwardly on curved slip support surface (19*a*) and flat slip support surfaces (19*b*) of slip support plates (18).

Similarly, the timing ring (24) may be moved vertically downward towards the upper support ring (22) by input of fluid or air into upper hydraulic port (15*a*) of actuators (14) to retract piston (16). The retraction of pistons (16) will in turn move slips (17) of the slip assemblies (13) radially inward by means of slip hangers (20) toward each other along outwardly curved slip support surfaces (19*a*) and flat slip support surfaces (19*b*) of the slip support plates (18).

Slip hangers (20) are pivotally attached to timing ring (24) by hinge block (29) wherein pivot links (30) allow slip hangers (20) to pivot radially towards and away from the vertical axis of spider (10). Hinge blocks (29) are affixed to timing ring (24) by fasteners (28) which may be any suitable fastening mechanism such as screws, bolts, pins, and the like. The slip hangers (20) are provided with a slip passage (21) which provides clearance to accommodate the passage of the slips (17) of the slip assembly (13) past slip hangers (20) as the timing ring (24) is moved upward and downward in response to retraction and extension of the piston rods (16) of the hydraulic cylinder actuators (14). Slip hangers (20) will pivot towards and away from the central axis of spider (10) when slip assemblies (13) move up and down along slip support plates (18).

Starting from an open position, as shown in FIG. 1, where the slips (17) of slip assemblies (13) are retracted at the top of outwardly curved slip support surface (19*a*), as the slip assembly (13) moves down along T-shaped edge (36) of slip support plate (18) by retraction of the timing ring (24) by powered actuators (14) the pivot links (30) of the slip assemblies (13) will move radially inward along slip support plates (18) while the pivot links (30) of hinge block (29) will remain in place on the timing ring (24). As the slips (17) reach the top of slip support surface (19*b*), the slip assemblies will begin to move down along the tapered slip support surface (19*b*) on T-shaped edge (36). As the slips (17) of slip assemblies (13) move radially inward down the tapered surface (19*b*) of the slip carrier plates (18), slip hangers (20) will pivot into a position over the slips (17) as to allow powered actuators (14) to place downward pressure upon slips (17) through the slip hangers (20) in order to grip a desired pipe string placed within the ringed opening (34) of the spider (10). Likewise, the slips (17) of the slip assemblies (13) will disengage a pipe string placed within the ringed opening (34) of spider (10) as the powered actuators (14) push timing ring (24) upward causing the slip hangers (20) to move up and pivot outward to pull slips (17) of the slip assemblies (13) upward along the tapered surface support surface (19*b*) and the curved slip support surface (19*a*) of slip carrier plates (18) away from the pipe string.

Figure 2:
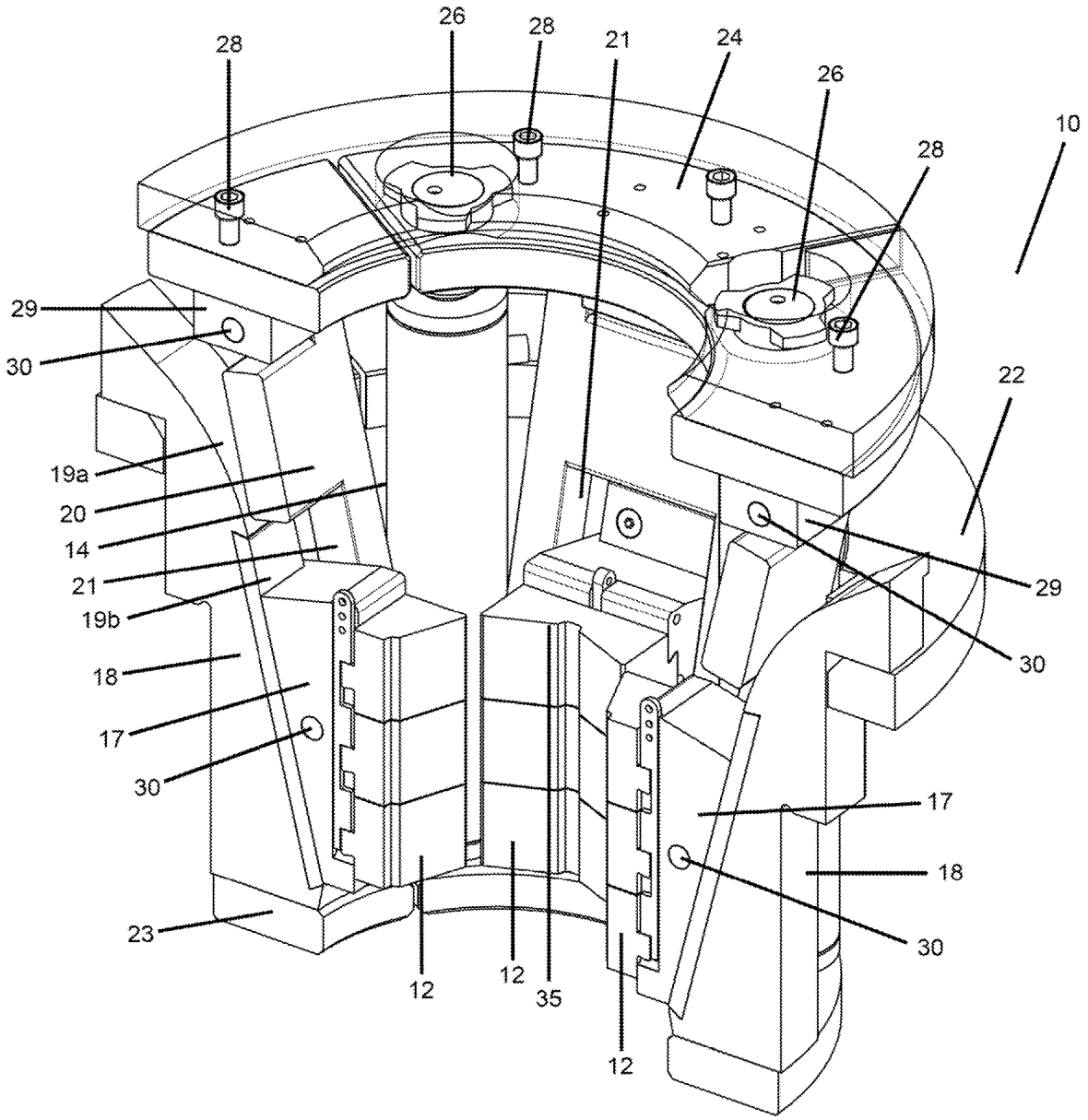
FIG. 2 is a perspective cross-sectional view of the pipe gripping apparatus of FIG. 1 with the pipe gripping slips in a closed position.
Figure 3:
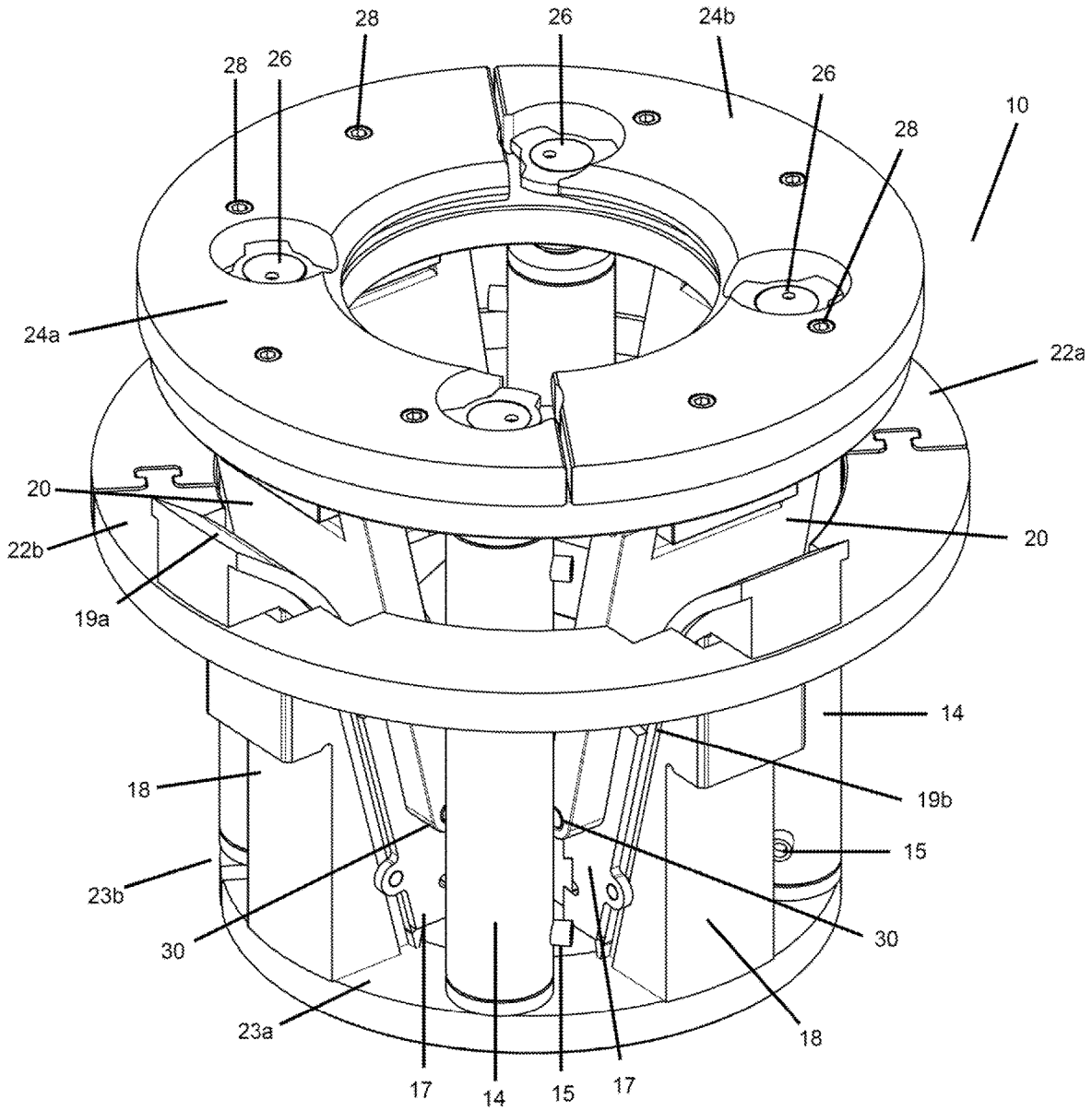
FIG. 3 is a perspective view of the pipe gripping apparatus of the pipe gripping apparatus of FIG. 1 in a closed position.

As shown in FIGS. 2 and 3, when the pistons (16) of the hydraulic cylinder actuators (14) are retracted, the slips (17) of slip assemblies (13), which are attached to the timing ring (24) by slip hangers (20), move downward along the outwardly curved slip support surfaces (19*a*) of slip carrier plates (18) and radially inward within the ringed opening (34). Because the slips (17) of the slip assemblies (13) move in unison radially inward, a pipe or pipe sting may be simultaneously gripped by the slips (17).

The V-shaped pipe gripping surface (35) on the slip (17) may or may not be provided with teeth or another enhanced gripping surface as the V-shaped pipe gripping surface serves to eliminate the need for teeth on the pipe contact surfaces of the slips (17) or any attached gripping members or dies (12). Thus the use of slips or dies with teeth on the pipe gripping surface may be reserved for situations where an enhanced grip is thought necessary.

As shown in FIG. 1, when the pistons (16) of the cylinders (14) are extended, the slips (17) of the slip assemblies (13) move in unison along slip support surfaces (19*a*) and (19*b*) of slip support plates (18) and radially outward from the ringed opening (34). The curved slip support plates (18) are outwardly curved so that the slips (17) move outward away from the ringed opening (34) to provide an unobstructed opening (34). An unobstructed opening (34) allows the spider (10) to accommodate a larger range of pipe diameters or equipment sizes as a part of the pipe string. Additionally, the outwardly curved surfaces (19*a*) of the slip support plates (18) will speed the radially inward and outward movement of slips (17) while minimizing the space or height required for operation of the spider (10). Similarly, as shown in FIG. 2 and FIG. 3, when pistons (16) are retracted to close the spider (10) for engagement with a pipe string within opening (34), the slips (17) of the slip assemblies (13) move in unison along slip support surfaces (19*a*) and (19*b*) of slip support plates (18) and radially inward into the ringed opening (34).

I claim:

1. A pipe gripping apparatus comprising:

(a) a plurality of slip support surfaces disposed radially around a central opening, wherein each said slip support surface has an upper region having a radially outwardly curved slip support surface with respect to the vertical axis of said central opening and a lower region having a flat inwardly tapered slip support surface with respect to the vertical axis of said central opening;

(b) a slip slidably mounted on each said slip support surface;

(c) a timing ring pivotally linked to each of said slips;

(d) an actuator whereby said slips may be slidably moved towards and away from each other along their corresponding slip support surfaces to engage and release a pipe; and (e) whereby movement of said slips fully upward and outward along said radially outwardly curved slip support surface of said upper region of said slip surfaces will move said slips away from said central opening thereby preventing obstruction of said central opening by said slips.

2. The pipe gripping apparatus recited in claim 1 wherein each of said slip support surfaces is disposed along the edge of a slip support plate.

3. The pipe gripping apparatus recited in claim 2 wherein said slip support plates are disposed radially around said central opening.

4. The pipe gripping apparatus recited in claim 3 further comprising a pipe gripping surface attached to each of said slips.

5. The pipe gripping apparatus recited in claim 4 wherein said actuator is a powered actuator.

6. The pipe gripping apparatus recited in claim 5 wherein said pipe gripping surface is V-shaped.

7. A pipe gripping apparatus comprising:

(a) a plurality of vertically oriented slip carrier plates, each of said slip carrier plates having a lower end with an inwardly tapered slip support surface and an upper end with a radially outwardly curved slip support surface;

(b) upper and lower support rings whereby said slip carrier plates arrayed to create a central opening;

(c) a plurality of pipe gripping slips, each of said pipe gripping having a slip slide surface, each said slip of said plurality of pipe gripping slips being slideably mounted on a corresponding said slip carrier plate of said plurality of slip carrier plates;

(d) a timing ring having a link pivotally attached to each said slip of said plurality of pipe gripping slips;

(e) at least one linear actuator whereby said timing ring may be moved upward and downward thereby moving each said slip of said plurality of pipe gripping slips in unison upward and downward and radially inward and outward along said inwardly tapered slip support surface of said slip carrier plates; and (f) whereby continued upward movement of said timing ring will move each said slip of said plurality of pipe gripping slips radially outward along said radially outwardly curved slip support surfaces of said upper end of said slip carrier plates thereby moving each said slip of said plurality of pipe gripping slips from said central opening.

8. The pipe gripping apparatus recited in claim 7 further comprising a pipe gripping surface attached to each of said slips.

9. The pipe gripping apparatus recited in claim 8 wherein said actuator is a powered actuator.

10. The pipe gripping apparatus recited in claim 9 wherein said pipe gripping surface is V-shaped.

11. The pipe gripping apparatus recited in claim 9 wherein said central opening is not obstructed by said slips.

12. The pipe gripping apparatus recited in claim 11 wherein said pipe gripping apparatus is a spider.

13. A pipe gripping apparatus comprising:

(a) a plurality of vertically oriented slip support surfaces disposed radially around the vertical axis of a central opening, each said vertically oriented slip support surface having an upper region with a vertically curved slip support surface extending outwardly away from said vertical axis of said central opening and a lower region with a slip support surface tapered inwardly toward said vertical axis of said central opening;

(b) a slip slidably mounted on each said slip support surface;

(c) a timing ring pivotally linked to each of said slips; and (d) an actuator whereby said slips may be slidably moved towards and away from each other along their corresponding slip support surfaces to engage and release a pipe.

14. The pipe gripping apparatus recited in claim 13 wherein each of said slip support surfaces is disposed along the edge of a slip support plate.

15. The pipe gripping apparatus recited in claim 14 wherein said slip support plates are disposed radially around said central opening.

16. The pipe gripping apparatus recited in claim 15 further comprising a pipe gripping surface attached to each of said slips.

17. The pipe gripping apparatus recited in claim 16 wherein said actuator is a powered actuator.

18. The pipe gripping apparatus recited in claim 17 wherein said pipe gripping surface is V-shaped.

* * * * *